US010815754B2

(12) United States Patent
Earle et al.

(10) Patent No.: US 10,815,754 B2
(45) Date of Patent: Oct. 27, 2020

(54) SPLITFLOW VALVE AND METHOD OF USE

(71) Applicant: SCHOELLER-BLECKMANN OILFIELD EQUIPMENT AG, Ternitz (AT)

(72) Inventors: Richard Earle, Youngsville, LA (US); Nathan Strilchuk, Alberta (CA)

(73) Assignee: SCHOELLER-BLECKMANN OILFIELD EQUIPMENT AG, Ternitz (AT)

( * ) Notice: Subject to any disclaimer, the term of this patent is extended or adjusted under 35 U.S.C. 154(b) by 0 days.

(21) Appl. No.: 16/333,762

(22) PCT Filed: Aug. 23, 2017

(86) PCT No.: PCT/EP2017/071251

§ 371 (c)(1),
(2) Date: Mar. 15, 2019

(87) PCT Pub. No.: WO2018/050418

PCT Pub. Date: Mar. 22, 2018

(65) Prior Publication Data

US 2019/0218885 A1 Jul. 18, 2019

(30) Foreign Application Priority Data

Sep. 16, 2016 (GB) ..... 1615817.2

(51) Int. Cl.
*E21B 34/10* (2006.01)
*E21B 21/10* (2006.01)
(Continued)

(52) U.S. Cl.
CPC ..... *E21B 34/102* (2013.01); *E21B 21/103* (2013.01); *E21B 34/14* (2013.01); *E21B 21/08* (2013.01); *E21B 2200/06* (2020.05)

(58) Field of Classification Search
CPC ..... E21B 34/102; E21B 34/14; E21B 34/007; E21B 21/103; E21B 21/08
See application file for complete search history.

(56) References Cited

U.S. PATENT DOCUMENTS 5,901,796 A * 5/1999 McDonald ..... E21B 21/103 166/321
6,041,874 A 3/2000 Lee
(Continued)

FOREIGN PATENT DOCUMENTS

CA 2 911 551 A1 5/2016
EP 2 484 862 A2 8/2012
(Continued)

OTHER PUBLICATIONS

Search Report for corresponding GB 1615817.2 dated Jan. 26, 2017, 3pp.
(Continued)

*Primary Examiner* — David J Bagnell
*Assistant Examiner* — Yanick A Akaragwe
(74) *Attorney, Agent, or Firm* — Lewis Roca Rothgerber Christie LLP

(57) ABSTRACT

A splitflow valve comprises a tubular body, a valve element and a lock. The tubular body defines a through hole and has at least one lateral bypass port. The valve element defines a flow restriction and is moveable along the through hole along a first direction between a first position and a second position, wherein the bypass port is closed by the valve element in the first position. In the second position the bypass port is open. The lock maintains the valve element in the second position wherein a flow of fluid entering the through hole of the tubular body is split into a first flow portion passing the flow restriction and a second flow portion exiting the at least one bypass port. Further, the lock is deactivatable to allow the valve element to return to the first position.

19 Claims, 4 Drawing Sheets

(51) Int. Cl.
*E21B 34/14* (2006.01)
*E21B 21/08* (2006.01)

(56) References Cited

U.S. PATENT DOCUMENTS

| | | | | |
|---|---|---|---|---|
| 6,820,697 | B1 | 11/2004 | Churchill | |
| 6,923,255 | B2 | 8/2005 | Lee | |
| 7,416,029 | B2 | 8/2008 | Telfer et al. | |
| 7,673,708 | B2 | 3/2010 | Lee | |
| 7,866,397 | B2 | 1/2011 | Lee | |
| 8,307,902 | B2 | 11/2012 | Telfer | |
| 8,844,634 | B2 | 9/2014 | Clausen et al. | |
| 9,328,579 | B2 | 5/2016 | Wilson | |
| 2003/0024706 | A1 | 2/2003 | Allamon | |
| 2006/0011354 | A1* | 1/2006 | Logiudice | E21B 21/103 166/380 |
| 2010/0252281 | A1* | 10/2010 | Telfer | E21B 21/103 166/386 |
| 2011/0120773 | A1* | 5/2011 | Hilliard | E21B 21/103 175/57 |
| 2012/0227973 | A1 | 9/2012 | Hart et al. | |
| 2014/0262312 | A1* | 9/2014 | Tilley | E21B 34/14 166/351 |
| 2015/0000920 | A1 | 1/2015 | Harris et al. | |
| 2015/0345256 | A1 | 12/2015 | Tulloch | |

FOREIGN PATENT DOCUMENTS

| | | | |
|---|---|---|---|
| GB | 2 309 470 | A | 7/1997 |
| GB | 2553834 | A | 3/2018 |
| WO | WO 99/47789 | A1 | 9/1999 |

OTHER PUBLICATIONS

Written Opinion for International Application No. PCT/EP2017/071251 dated Nov. 8, 2017, 7pp.

International Search Report for corresponding International Application No. PCT/EP2017/071251, dated Nov. 8, 2017, 7pp.

* cited by examiner

SPLITFLOW VALVE AND METHOD OF USE

CROSS-REFERENCE TO RELATED APPLICATIONS

This Application is a National Phase Patent Application and claims priority to and the benefit of International Application Number PCT/EP2017/071251, filed on Aug. 23, 2017, which claims priority to and the benefit of Great Britain Patent Application No. 1615817.2 (GB), filed Sep. 16, 2016, the entire contents of all of which are incorporated herein by reference.

FIELD OF INVENTION

The present invention relates to the field of splitflow valves usable e.g. in drillstrings or coiled tubings.

BACKGROUND

U.S. Pat. No. 6,923,255 B2 discloses an activating ball assembly comprising a large deformable ball. The ball is of a size sufficient to engage and to be held captive by a valve seat which it engages in order to activate the by-pass tool, but is deformable so as to subsequently be capable of being forced downwardly through the valve seat after launching of a second and smaller hard de-activating ball. A weight is attached to the ball. An open ended narrow passage may be provided which extends lengthwise of the ball and the weight between an inlet end in the ball and an outlet in the weight.

U.S. Pat. No. 7,866,397 B2 discloses an activating mechanism for controlling the operation of a downhole tool and which comprises: a hollow main body adapted for mounting in a drill-string and through which fluid to the tool can be routed. The activating mechanism further comprises an actuating sleeve defining a through-flow passage and slidably mounted in the main body for movement between positions corresponding to a through-flow mode and a by-pass mode of the mechanism, and biasing means acting on the sleeve to urge it to its position corresponding to the through-flow mode of the mechanism. The activating mechanism further comprises a seat providing access to said passage in the through-flow mode of the mechanism and a deformable activator capable of being launched down the drill-string to engage the seat and thereby cause pressure upstream of the seat to increase so that the activator moves the sleeve to its position corresponding to the by-pass mode of the mechanism, in which the activator and the seat are arranged to cooperate with each other, when the activator engages the seat, in such a way that restricted flow of fluid through the sleeve is maintained when the mechanism is in its by-pass mode.

SUMMARY

Available splitflow valves which are able to provide split flow, i.e. directing part of the drilling fluid pumped to the splitflow valve to the drill bit and the directing another part of the drilling fluid into the annulus often require complex hydrodynamic calculations and accurate control of the fluid pressure in the drillstring in order to provide a desired split ratio, i.e. a desired ratio of the amount of drilling fluid going to the drill bit over the amount of drilling fluid going to the annulus.

In view of the above-described situation, there still exists a need for an improved technique that enables to provide a desired split ratio.

This need may be met by the subject matter according to the independent claims. Advantageous embodiments of the herein disclosed subject matter are described by the dependent claims.

According to an embodiment of a first aspect of the herein disclosed subject matter there is provided a splitflow valve comprising: a tubular body defining a through hole, the tubular body having at least one lateral bypass port; a valve element moveable in the through hole along a first direction between a first position and a second position, the bypass port being closed by the valve element in the first position, the bypass port being open in the second position, the valve element defining a flow restriction; a lock maintaining the valve element in the second position wherein the a flow of fluid entering the through hole of the tubular body is split into a first flow portion passing the flow restriction and a second flow portion exiting the at least one bypass port; the lock being deactivatable to allow the valve element to return to the first position.

In accordance with the second aspect, a splitflow valve assembly is provided, the splitflow valve assembly comprising a splitflow valve according to one or more embodiments disclosed herein; and an activating element according to one or more embodiments disclosed herein.

According to an embodiment of a third aspect of the herein disclosed subject matter there is provided a method for operating a splitflow valve comprising a tubular body defining a through hole, the tubular body having at least one lateral bypass port and a valve element moveable in the through hole along a first direction between a first position and a second position, the bypass port being closed by the valve element in the first position, the bypass port being open in the second position, the valve element defining a flow restriction, the method comprising: moving the valve element from the first position into the second position; maintaining the valve element in the second position while having the flow restriction unobstructed such that a flow of fluid entering the through hole of the tubular body is split into a first flow portion passing the flow restriction and a second flow portion exiting the at least one bypass port; thereafter moving the valve element from the second position into the first position.

DESCRIPTION OF EXEMPLARY EMBODIMENTS

In the following, exemplary embodiments of the herein disclosed subject matter are described, any number and any combination of which may be realized in an implementation of aspects of the herein disclosed subject matter.

According to embodiments of the first aspect, a splitflow valve according to the herein disclosed subject matter is adapted for providing the functionality or features of one or more of the herein disclosed embodiments and/or for providing the functionality or features as required by one or more of the herein disclosed embodiments, in particular of the embodiments of the second and third aspect disclosed herein.

According to embodiments of the second aspect, a splitflow valve assembly according to the herein disclosed subject matter is adapted for providing the functionality or features of one or more of the herein disclosed embodiments and/or for providing the functionality or features as required by one or more of the herein disclosed embodiments, in particular of the embodiments of the first and the third aspect disclosed herein.

According to embodiments of the third aspect, a method according to the herein disclosed subject matter is adapted for providing the functionality or features of one or more of the herein disclosed embodiments and/or for providing the functionality or features as required by one or more of the herein disclosed embodiments, in particular of the embodiments of the first and the second aspect disclosed herein.

According to an embodiment, a splitflow valve (hereinafter also referred to as "valve") comprises a tubular body defining a through hole, the tubular body having at least one lateral bypass port and a valve element moveable in the through hole along a first direction between a first position and a second position. The bypass port is closed by the valve element in the first position and is open in the second position. The valve element defines a flow restriction (also referred to as first flow restriction) for drilling fluid flowing through the through hole. A lock is provided for maintaining the valve element in the second position wherein a flow of fluid entering the through hole of the tubular body is split into a first flow portion passing the flow restriction and a second flow portion exiting the at least one bypass port. The lock is deactivatable to allow the valve element to return to the first position.

According to an embodiment, a method for operating the splitflow valve is provided, the method comprising (i) moving the valve element from the first position into the second position; (ii) maintaining the valve element in the second position while having the flow restriction unobstructed such that a flow of fluid entering the through hole of the tubular body is split into a first flow portion passing the flow restriction and a second flow portion exiting the at least one bypass port; and (iii) thereafter moving the valve element from the second position into the first position.

According to an embodiment, the valve is adapted for of being activated (bypass port(s) open) and deactivated (bypass port(s) closed) multiple times (hence, the valve may be referred to as multiple activation bypass tool).

According to an embodiment, the bypass port comprises an insert. According to an embodiment, the insert is a nozzle. According to a further embodiment, the nozzle is interchangeable to adjust the split (i.e. the split ratio) of the flow of fluid. According to a further embodiment, the nozzle which is adjustable to adjust the split of the flow of fluid. For example, according to an embodiment the nozzle defines (forms) a flow restriction for a bypass flow of drilling fluid going through the bypass port (this flow restriction being also referred to as second flow restriction). According to an embodiment, the insert is a seal closing (sealing off) the bypass port. In this embodiment, all flow through the bypass port is blocked. According to an embodiment, in case of two or more bypass ports, one bypass port may be sealed off (e.g. by providing the bypass port with a seal) and one bypass port is kept open (e.g. by providing the bypass port with a nozzle).

Hence, by changing the second flow restriction (e.g. by interchanging the insert or nozzle or by adjusting the nozzle) the split ratio can be changed without changing the flow restriction through the tubular body. Hence, according to an embodiment the tubular body defines a fixed flow restriction.

According to an embodiment, the method further comprises adjusting the split of the flow of fluid, in particular by interchanging or adjusting an insert (e.g. a nozzle) of the bypass port.

According to an embodiment, the valve element comprises a seat for receiving an activating element, the activating element allowing to move the valve element into the second position; the activating element being removable from the seat; and the lock being configured for maintaining the valve element in the second position after removal of the activating element from the seat to allow the first flow portion pass through the seat.

According to a further embodiment the method further comprises (a) receiving an activating element in the seat; (b) increasing a fluid pressure upstream the activating element to thereby move the valve element to the second position; (c) removing the activating element from the seat; and (d) maintaining the valve element in the second position and passing the first flow portion through the seat.

According to an embodiment, the activating element is a ball, e.g. a deformable ball. A deformable ball has the advantage that it can be pushed through the seat by increasing the pressure in the drilling fluid behind (upstream) the ball to or beyond a necessary level. A ball as an activating element has the advantage that it is long proven in its suitability and its reliability.

According to a further embodiment, the activating element is a deformable dart, e.g. a dart made of metal and comprising a deformable ring which engages the seat. The deformable ring may have any suitable configuration and is inwardly deformable so as to reduce the outer diameter of the deformable ring. Such an inward deformation allows the deformable dart to pass through the seat. According to an embodiment the deformable ring is made of polymer material. According to another embodiment, the deformable ring is a metal ring with at least one cutout that allows the ring to reduce its diameter (e.g. the metal ring with a single cutout corresponds to a split ring). The at least one cutout may be filled with a deformable material such as polymer material (e.g. plastic or rubber) in order to prevent debris from entering the cutout and thereby blocking the (inward) deformation of the ring, while still maintaining the deformability of the metal ring. If the metal ring includes two or more cutouts, the deformable material in the cutouts may necessary to maintain the integrity of the ring which would otherwise fall into individual pieces (if no other measures are provided).

According to a further embodiment, the seat may be deformable. In such a case, the activating element (e.g. the ball or the dart) may be non-deformable.

According to a further embodiment, the seat defines the first flow restriction after the activating element has been removed from the seat. Usually the seat is not altered during a different uses of the valve. However, by changing the second flow restriction (of the bypass port(s)) the split ratio can easily be changed even in such a case. Removal of the activating element from the seat for providing split flow has the advantage that it is not the activating element that has to provide the first flow restriction and which has to provide a through flow passage. Due to the abrasive nature of drilling fluid which may contain sand, cuttings, etc. such a through flow passage would be subject to wear, in particular if portions of the through flow passage would be made of polymer material. Hence, the possibility to manufacture the seat from a material such as metal, e.g. hardened metal, allows providing a split ratio that does not change during the operation (i.e. during maintaining the valve element in the second position) due to wear.

According to an embodiment, the splitflow valve further comprises a bias element biasing the valve element into the first position; the activating element received in the seat allowing to increase a fluid pressure upstream the seat to thereby move the valve element against a (biasing) force of the bias element.

According to a further embodiment, the method further comprises biasing the valve element with a biasing force (e.g. exerted by the bias element) into the first position; and increasing a fluid pressure upstream the seat to thereby move the valve element against the biasing force into the second position.

The biasing element may provide the further advantage that the force in upstream direction (opposite the downward flow of drilling fluid) is provided in an easy manner. Such a force in upstream direction may be used for the activation or deactivation of the lock, depending on the actual configuration of the lock.

According to an embodiment, the though hole of the tubular body has an inlet end for receiving the flow of fluid. According to an embodiment, the inlet end of the tubular body is configured for being attached to (e.g. threaded to) a drillstring. According to a further embodiment, the bypass port is tilted (inclined) toward the inlet end. Hence, in this embodiment the bypass port forms an angle with the first direction of the tubular body, wherein the angle is different from 90 degrees, wherein the bypass port defines a bypass direction thereof which has a component in upstream direction, i.e. in the direction opposite the flow of drilling fluid which enters the inlet end of the tubular body. Further, when having regard to the second flow portion, also the second flow portion through the bypass port has a component in the upstream direction. According to another embodiment, the angle is 90 degrees (resulting in the second flow portion being directed radially outwardly).

According to a further embodiment, the method comprises directing the second flow portion such that the second flow portion exits the bypass port with a velocity component in upstream direction, opposite a downstream direction in which the flow of fluid enters the through hole (e.g. by the angle being smaller than 90 degrees).

According to an embodiment, the lock further comprises a first profile element and a second profile element moveable with respect to each other along a second direction, transverse to the first direction; one of the first profile element and the second profile element (i.e. the first profile element or the second profile element) being coupled with the valve element such that along the first direction the profile element coupled with the valve element moves in conjunction with the valve element; wherein the first profile element and the second profile element depending on their position relative to each other along the second direction define the position of the valve element along the first direction (e.g. in a direction opposite the first direction).

According to a further embodiment the method comprises: moving the first profile element and the second profile element with respect to each other along the second direction into a locking position in which the first profile element and the second profile element cooperate with each other to maintain the valve element in the second position.

For example, according to an embodiment the second direction is a circumferential direction and the first profile element and the second profile element are rotatable with respect to each other (i.e. movability is rotatability in this embodiment). However, other types of movability are also contemplated, e.g. linear movability, movability in a single direction (e.g. single circumferential direction), movability in opposite directions (e.g. in opposite circumferential directions), etc.

According to an embodiment, the second profile element is rotatably mounted on the valve element in particular by a bearing, wherein the second profile element is rotatable with respect to the valve element along the second direction.

According to a further embodiment, the bearing comprises a plurality of rolling bearing elements (e.g. balls or rollers) and wherein the second profile element comprises an opening in the second profile element, the opening providing access to a reception space configured for receiving the rolling bearing elements. According to an embodiment, the reception space is defined by at least one groove. According to a further embodiment, the reception space is defined by two grooves facing each other. According to a further embodiment, the two grooves facing each other are provided in two elements movable with respect to each other, for example in the valve element and in the second profile element.

According to an embodiment, the valve further comprises a third profile element and a fourth profile element; wherein the third profile element and the fourth profile element are configured for cooperating so that a force pushing the third profile element and the fourth profile element against each other along the first direction results in a force acting to move the third and fourth profile element with respect to each other along the second direction; and wherein one of the first profile element and the second profile element (i.e. the first profile element or the second profile element) is coupled with one of the third and the fourth profile element (i.e. the third profile element or the fourth profile element) such that a movement of the third and the fourth profile element relative to each other along the second direction results in a movement of the first and second profile element relative to each other along the second direction.

Hence, according to an embodiment the third profile element is operable to move the first profile element and the second profile element with respect to each other. For example, the coupling between one of the first profile element and the second profile element with one of the third and the fourth profile element may be effected between the second profile element and the third profile element. For example, according to an embodiment the second profile element and the third profile element may be fixed to each other. According to an embodiment, the coupling of the two respective profile elements may be performed by attaching the profile elements to each other or by manufacture the profile elements from a single piece of material, thereby resulting in a single profile assembly which performs the functions of the two respective profile elements.

According to a further embodiment, the method further comprises: pushing the third profile element and the fourth profile element against each other along the first direction to thereby generate, by virtue of respectively configured opposing surface profiles of the third profile element and the fourth profile element, a force acting to move the first and the second profile element with respect to each other along the second direction.

According to embodiments of the herein disclosed subject matter, the lock according to embodiments of the herein disclosed subject matter may be configured in any degree of detail like the clutch mechanism described in one or more of the following U.S. Pat. Nos. 7,673,708 B2, 6,041,874 A. In this regard, the first profile element, the second profile element plus the third profile element and the fourth profile element described herein may be configured similar or identical to the first, second and third clutch member described in U.S. Pat. Nos. 7,673,708 B2 and/or 6,041,874 A.

According to a further embodiment, the second profile element and the third profile element are formed by a single piece of material.

According to a further embodiment, the valve element is formed by a single piece of material.

According to an embodiment, the splitflow valve further comprises a check valve. It should be understood that if the split flow valve is activated by an activating element, the check valve is configured to allow the activating element pass the check valve. According to a further embodiment, the check valve is configured for preventing or limiting flow of drilling fluid in the upstream direction. According to a further embodiment, the check valve is a flapper valve.

According to an embodiment, the tubular body comprises a protrusion protruding over a neighboring outer surface of the tubular body. According to the further embodiment the bypass port extends at least partially through the protrusion. According to an embodiment, the protrusion of the tubular body comprises a first surface portion (pad area). According to a further embodiment, two or more protrusions are provided, each protrusion having a first surface portion. According to an embodiment, neighboring first surface portions are spaced from each other to allow flow of drilling fluid between neighboring first surface portion. According to a further embodiment, the first surface portion has the shape of a cylinder segment.

In accordance with the second aspect, a splitflow valve assembly is provided, the splitflow valve assembly comprising the splitflow valve according to one or more embodiments disclosed herein; and the activating element according to one or more embodiments disclosed herein.

In the above there have been described and in the following there will be described exemplary embodiments of the subject matter disclosed herein with reference to a splitflow valve, a splitflow valve assembly and a method of operating a splitflow valve. It has to be pointed out that of course any combination of features relating to different aspects of the herein disclosed subject matter is also possible. In particular, some features have been or will be described with reference to device type embodiments (e.g. relating to a splitflow valve or a splitflow valve assembly) whereas other features have been or will be described with reference to method type embodiments (e.g. relating to a method of operating a splitflow valve). However, a person skilled in the art will gather from the above and the following description that, unless noted otherwise, in addition to any combination of features belonging to one aspect also any combination of features relating to different aspects or embodiments, for example even combinations of features of device type embodiments and features of the method type embodiments are considered to be disclosed with this application. In this regard, it should be understood that any method feature derivable from a corresponding explicitly disclosed device feature should be based on the respective function of the device feature and should not be considered as being limited to device specific elements disclosed in conjunction with the device feature. Further, it should be understood that any device feature derivable from a corresponding explicitly disclosed method feature can be realized based on the respective function described in the method with any suitable device disclosed herein or known in the art.

The aspects and embodiments defined above and further aspects and embodiments of the herein disclosed subject matter are apparent from the examples to be described hereinafter and are explained with reference to the drawings, but to which the invention is not limited. The aforementioned definitions and comments are in particular also valid for the following detailed description and vice versa.

DETAILED DESCRIPTION

Figure 1:
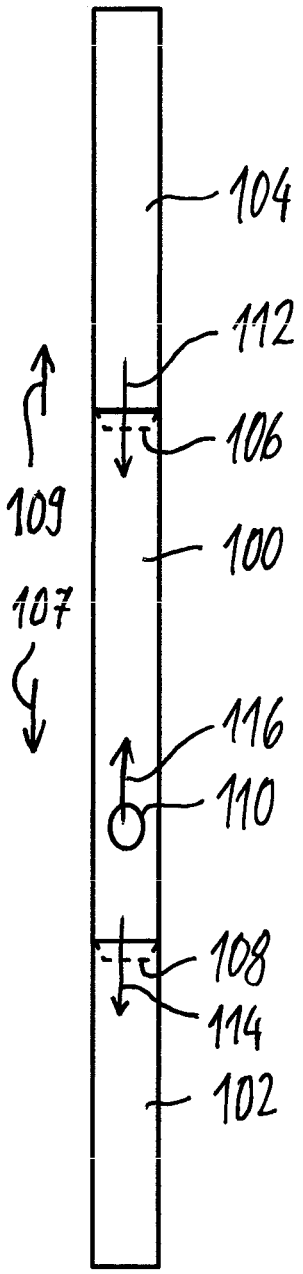
FIG. 1 shows a side view of part of a splitflow valve according to embodiments of the herein disclosed subject matter.

The illustration in the drawings is schematic. It is noted that in different figures, similar or identical elements are provided with the same reference signs. Accordingly, the description of the similar or identical features is not repeated in the description of subsequent figures in order to avoid unnecessary repetitions. Rather, it should be understood that the description of these features in the preceding figures is also valid for the subsequent figures unless explicitly noted otherwise.

FIG. 1 shows a side view of part of a splitflow valve 100 according to embodiments of the herein disclosed subject matter, wherein the splitflow valve is mounted in a drillstring 102, 104. In such an embodiment, the splitflow valve may be referred to as "drillstring splitflow valve". Although some embodiments refer to a drillstring splitflow valve, it should be understood that the splitflow valve may generally be used in hollow strings, e.g. also in a coiled tubing.

In accordance with an embodiment, the splitflow valve 100 (hereinafter referred to as valve 100) comprises an upper mounting portion 106 and the lower mounting portion 108. According to an embodiment, the upper and the lower mounting portions 106, 108 are threaded portions configured to be threaded to a respective lower part 102 of the drillstring and an upper part 104 of the drillstring. For example, according to an embodiment the upper part 104 of the drillstring is connected to a pump station (not shown in FIG. 1). According to a further embodiment, the lower part 102 of the drillstring is connected to a drill bit (not shown in FIG. 1). The drillstring is configured for drilling a downhole into the earth crust, e.g. for exploitation of hydrocarbons or hot water. The upper mounting portion 106 and the lower mounting portion 108 of the valve 100 further define a downstream direction 107, i.e. a direction from the upper mounting portion 106 to the lower mounting portion 108. Further, the upper mounting portion 106 and the lower mounting portion 108 define an upstream direction 109 which is opposite the downstream direction 107, i.e. from the lower mounting portion 108 to the upper mounting portion 106.

The valve 100 comprises a bypass port 110. For example, in accordance with an embodiment the valve 100 comprises a single bypass port 110. According to other embodiments, the number of bypass ports 110, is two, three, four, or more. A flow of fluid 112 (e.g. drilling fluid) which enters the valve 100 (in particular a through hole of a tubular body of the valve 100) is split into a first flow portion 114 and a second flow portion 116. According to an embodiment, the first flow portion 114 passes axially through the valve 100, exits the valve 100 at the lower mounting portion 108, and further propagates through the lower part 102 of the drillstring. The second flow portion 116 exits the valve 100 through the at least one bypass port 110.

According to an embodiment, the second flow portion 116 which exits the at least one bypass port 110 is at least partially directed upstream, i.e. it has a velocity component in the upstream direction 109 which is opposite the direction of the flow of fluid 112 which propagates in downstream direction (towards the drill bit).

Figure 2:
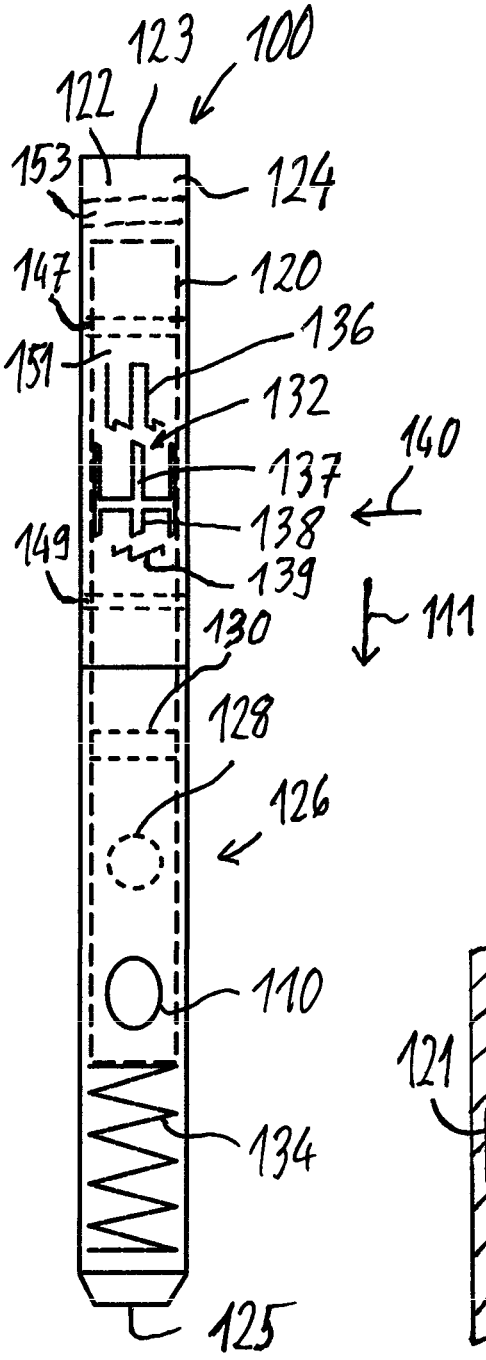
FIG. 2 shows the valve of FIG. 1 in greater detail.

FIG. 2 shows the valve 100 of FIG. 1 in greater detail.

According to an embodiment, a tubular body 124 comprises a through hole 122 with an inlet end 123 and an outlet end 125. According to an embodiment, the inlet end 123 is located at the upper mounting portion 106 and the outlet end 125 is located at the lower mounting portion 108 (see FIG. 1). In accordance with an embodiment, the valve 100 comprises a valve element 120 which is movable in the through hole 122 of a tubular body 124 of the valve 100. According to an embodiment, the valve element 120 is a sleeve. The valve element 120 is movable along a first direction 111 which according to an embodiment is parallel to the direction of the flow of fluid 112 which during operation of the valve 100 enters the through hole 122. In particular, the valve element 120 is movable in the first direction 111 between a first position 126 shown in FIG. 2, in which the bypass port 110 is closed by the valve element and a second position. In the second position (not shown in FIG. 2) the bypass port 110 is open due to an alignment of an opening 128 in the valve element 120 with the bypass port 110. By virtue of the alignment of the opening 128 and the bypass port 110 the interior of the valve element 120 is fluidically coupled with the bypass port 110. According to an embodiment, the first direction 111 is the downstream direction 107 (in this embodiment the terms "first direction" and the term "the downstream direction" may be used interchangeably. Unless clearly stated to the contrary, a movement of the valve element 120 described herein refers to a movement of the valve element 120 with respect to the tubular body 124.

The valve element 120 defines a flow restriction. According to an embodiment, the flow restriction is defined by a seat 130 which is provided for catching an activating element (not shown in FIG. 2), such as a ball or a dart. In accordance with an embodiment, the seat 130 is located upstream the opening 128. According to another embodiment, the flow restriction is just defined by the inner diameter of the valve element 120 which is necessarily smaller than the inner diameter of the through hole 122 which accommodates the valve element 120. Further, it is noted that an activating element is not necessarily needed in other embodiments. For example, the valve element may be operated solely by pressure (without activating element), e.g. by a pressure differential as described in U.S. Pat. No. 6,041,874.

According to an embodiment, the valve 100 comprises a lock 132 which is configured to maintain the valve element 120 in the second position, while the lock is deactivatable to allow the valve element 122 return to the first position. According to an embodiment, the lock comprises at least two profile elements which are configurable (e.g. moveable with respect to each other) to define the position of the valve element 120, in particular to define the position of the valve element 120 in a direction opposite the first direction 111, i.e. in a direction from the second position to the first position 126.

According to a further embodiment, the valve 100 comprises a bias element 134 which is configured for biasing the valve element 120 into the first position 126 with a biasing force. Generally, the bias element 134 is a counter element for an activating force that is applied to the valve element 120 moving the valve element 120 from the first position into the second position.

According to an embodiment, the lock 132 is located upstream the seat 130, i.e. is spaced from the seat 130 in a direction opposite the first direction 111. According to a further embodiment, the lock 132 is located upstream the opening 128 in the valve element 120. According to a further embodiment, a first profile element 136 of the lock has a fixed position with respect to the tubular body 124 (fixed along the first direction and the second direction) and a second profile element 137 of the lock 132 is limited in its movement with regard to the valve element 120 along the first direction 111. For example, according to an embodiment the second profile element 137 has a fixed position with respect to the valve element 120 along the first direction 111 while along a second direction 140 the second profile element 137 is movable with respect to the valve element 120. For example, according to an embodiment the second profile element 137 is rotatable with respect to the valve element 120 along the second direction. For example, according to an embodiment, the second profile element 137 is rotatably mounted (i.e. mounted so as to be rotatable) on the valve element 120, e.g. by a bearing. According to an embodiment, any rotatability (e.g. movement in the second direction 140) is provided by a bearing including a plurality of rolling bearing elements. According to a further embodiment, for assembling the splitflow valve, the rolling bearing elements are inserted into a reception space, e.g. through an opening in a radially outer element defining the reception space. For example, according to an embodiment where the second profile element 137 is rotatably mounted on the valve element 120, the reception space for the rolling bearing elements may be provided between the second profile element 137 and the valve element 120 and the rolling bearing elements may be inserted through an opening in the second profile element 137 into the reception space (see also embodiments described with regard to FIG. 7 below).

According to an embodiment, the rolling bearing elements run in a (e.g. circumferential) groove in the second profile element 137 and/or a (e.g. circumferential) groove in the valve element 120 (i.e. in an embodiment the reception space between second profile element 137 and the valve element 120 is provided by at least one groove). If a groove is provided in both, the second profile element 137 and the valve element 120, the rolling bearing elements provide for a limited movability (e.g. the fixed position) of the second profile element 137 and the valve element 120 in the first direction 111.

According to an embodiment, the valve element comprises two or more parts. This may facilitate mounting the bearing on the valve element. According to another embodiment, the valve element 120 is formed from a single piece of material. This may improve reliability of the tool. In case of a single piece valve element 120 the bearing (if present) may be mounted by inserting rolling bearing elements between the second profile element 137 and the valve element 120, e.g. as described above.

According to an embodiment, the lock 132 comprises a third profile element 138, wherein the second profile element 137 and a third profile element 138 are, in accordance with an embodiment, formed by a single piece of material. Hence, the second profile element 137 and the third profile element 138 move together and may be rotatably mounted on the valve element 120.

A fourth profile element 139 of the lock may be provided for cooperating with the third profile element 138 to thereby move the valve element 120 and the tubular body 124 with respect to each other. According to an embodiment, the fourth profile element 139 of the lock has a fixed position with respect to the tubular body 124 first direction 111 and the second direction 140. According to an embodiment, the first profile element 136 and the fourth profile element 139 are attached to the tubular body 124, e.g. by screws (not shown in FIG. 2).

According to an embodiment, the lock 132 is sealed with regard to the through hole 122. For example, according to an embodiment, the lock 132 is located in a sealed space 151. This prevents drilling fluid in the through hole 122 from entering the lock 132. By the sealing of the lock 132, reliable operation of the lock 132 can be insured. Sealing may be achieved by one or more sealing elements mounted in a fluid path between the through hole and the lock 132. According to an embodiment, the lock 132 is provided between (or is provided at least partially by) an inner surface of the tubular body 124 and an outer surface of the valve element 120. In such an embodiment, seal rings may be provided between the inner surface of the tubular body 124 and the outer surface of the valve element 120. According to an embodiment, a first seal ring 147 is located between the lock 132 and the inlet end 123 and a second seal ring 149 is located between the lock 132 and the outlet end 125. For example, if the lock 132 is implemented by profile elements 136, 137, 138, 139 which are in part located on an inner surface of the tubular body 124 and in part on an outer surface of the valve element 120, the seal rings may be located between the inner surface of the tubular body 124 and the outer surface of the valve element 120, wherein a first seal ring 147 is located upstream the profile elements 136, 137, 138, 139 (i.e. between the profile elements 136, 137, 138, 139 and the inlet end 123) and a second seal ring 149 is located downstream the profile elements 136, 137, 138, 139 (i.e. between the profile elements 136, 137, 138, 139 and the outlet end 125), as shown in FIG. 2. According to an embodiment, the sealed space 151, in which the lock 132 is located, is filled with a liquid, e.g. oil. The oil may serve to lubricate the lock. Further, the liquid (e.g. the oil) may be under pressure in order to reduce the probability of leakage of drilling fluid into the sealed space 151. According to an embodiment, the inner surface of the tubular body 124, the outer surface of the valve element 120, the first seal ring 147 and the second seal ring 149 form the sealed space 151. According to an embodiment, the one or more sealing elements (e.g. the seal rings 147, 149) are mounted in the tubular body 124 (and may extend to the outer surface of the valve element 120. In other words, in an embodiment, the one or more sealing elements have a fixed position with regard to the tubular body 120.

According to an embodiment, the splitflow valve 100 comprises a check valve 153. According to an embodiment, the check valve 153 is provided for safety reasons, to prevent drilling fluid to stream back in the upstream direction 109. Hence, according to an embodiment, the check valve is configured for preventing drilling fluid from streaming back in upstream direction. For example, the check valve 153 may provide for well control if for any reason the valve element 120 is stuck in the second position (bypass ports open). According to an embodiment, the check valve 153 is a flapper valve which allows for passing an activating element (not shown in FIG. 2) in downstream direction 107.

Figure 2A:
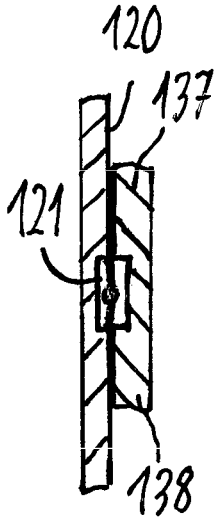
FIG. 2A shows a cross sectional view of part of the valve element and part of the second profile element and the third profile element mounted on the valve element.

FIG. 2A shows a cross sectional view of part of the valve element 120 and part of the second profile element 137 and the third profile element 138 mounted on the valve element 120. According to an embodiment, the second profile element 137 and the third profile element 138 are rotatably mounted on the valve element by at least one bearing 121. According to an embodiment, the bearing 121 is at least partially recessed in the valve element 120 or in the respective profile element 137, 138 in order to keep a (radial) spacing between the valve element 120 and the profile element(s) 137, 138 small.

Figure 3:
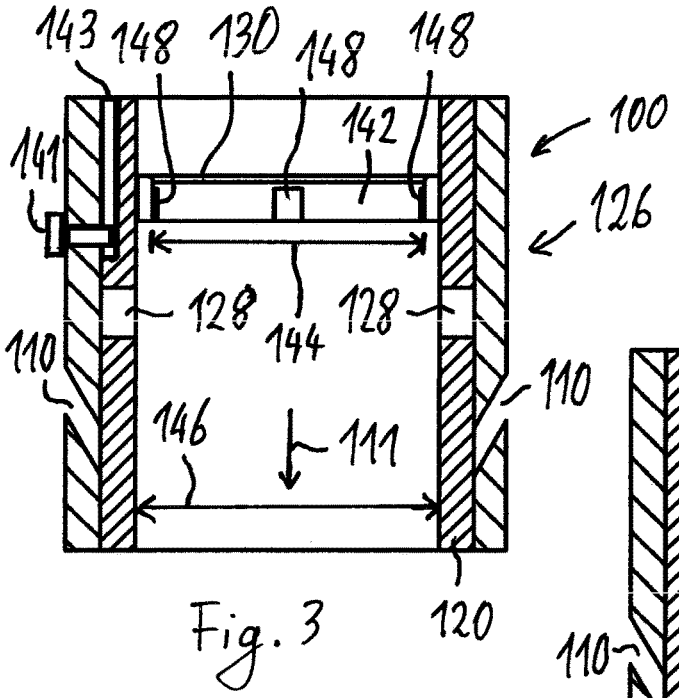
FIG. 3 to FIG. 5 show a part of the splitflow valve of FIG. 2 in greater detail, with the valve element in different positions.

FIG. 3 shows a part of the splitflow valve 100 of FIG. 2 in greater detail.

FIG. 3 shows the valve element 120 in the first position 126, in which the bypass ports 110 are closed by the valve element 120. In accordance with an embodiment, in the first position 126 the openings 128 in the valve element 120 are not aligned with the bypass ports 110, as shown in FIG. 3. In accordance with an embodiment, the valve seat 130 is located above (upstream) the openings 128, and is, in accordance with an embodiment, spaced from the openings 128 along the first direction 111, as shown in FIG. 3.

According to an embodiment, the seat 130 comprises an annular element 142 which has a first inner diameter 144 which is smaller than the inner diameter 146 of the valve element 120. Hence, the annular element 142 defines a flow restriction. According to a further embodiment, the annular element 142 comprises one or more protrusions 148 which define the force that is necessary to push an activating element (not shown in FIG. 3) through the annular element 142 and past the one or more protrusions 148.

Movability may be limited in one or more directions by means of a guide pin and a groove. For example according to an embodiment, with regard to the tubular body 124 the valve element 120 is moveable along the first direction 111 but is fixed along the second direction 140 (i.e. the tubular body 124 and the valve element 120 are not rotatable with respect to each other). This may be accomplished by a guide pin 141 which is attached to the tubular body and which runs in a groove 143 in the valve element 120. The groove 143 extends along the first direction 111.

Figure 4:
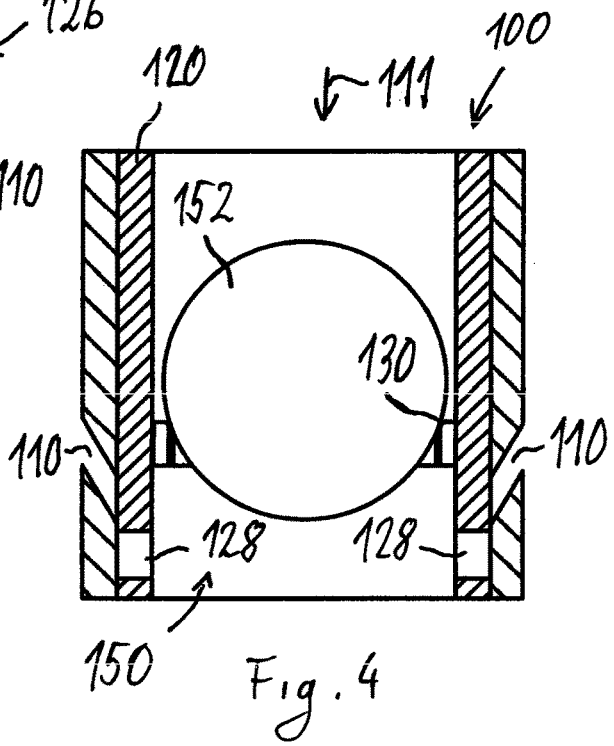

FIG. 4 shows the valve 100 with the valve element 120 in an intermediate position 150. Further FIG. 4 shows the valve 100 with an activating element 152 in the seat 130. According to an embodiment, the activating element 152 is a deformable ball, as shown in FIG. 4. According to other embodiments, the activating element may be any suitable element which is configured for interacting with the seat in order to move the valve element 120 into the second position or into the intermediate position 150.

According to an embodiment, the bias element 134 (not shown in FIG. 4, see FIG. 2) is configured to be compressible with a fluid pressure acting on the activating element 152 and the seat 130. Hence, with the activating element 152 on the seat 130, by increasing the pressure upstream the activating element 152 the valve element 120 can be shifted downwardly, against the biasing force of the bias element 134. According to an embodiment, the valve element 120 and in particular the lock 132 (not shown in FIG. 4) are configured such that the valve element 120 is movable into the intermediate position 150, in which the bias element 134 is more compressed than in the second position where the openings 128 are aligned with the bypass ports 110. In other words, according to an embodiment in the intermediate position 150 the openings 128 are in a position which is shifted in the first direction 111 (downstream direction) compared to the second position, as shown in FIG. 4.

Figure 5:
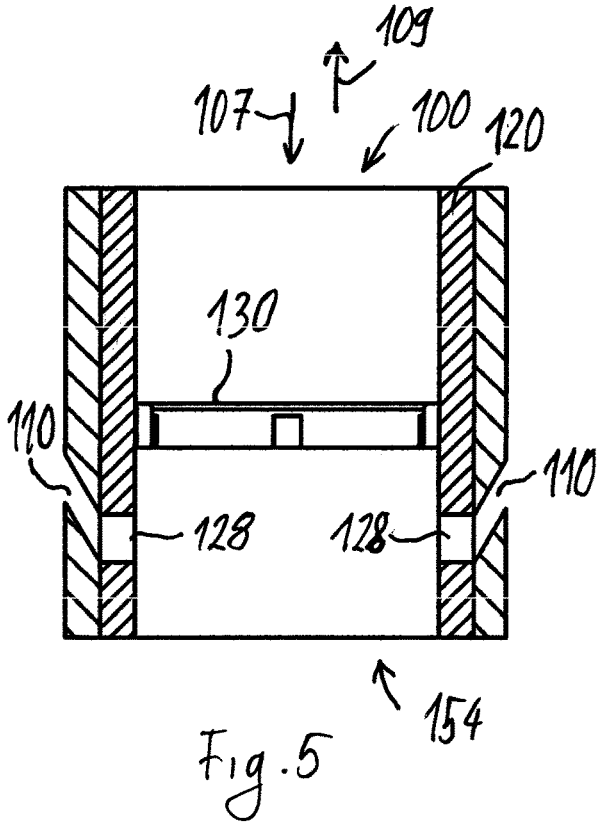

FIG. 5 shows the valve in the second position 154. In accordance with an embodiment, in the second position 154 the openings 128 are aligned with the bypass ports 110. The term "aligned" in this regard means that there is at least some overlap between the opening 128 and the corresponding bypass port 110 such that a flow of fluid through the opening 128 and further through the bypass port 110 is possible. According to an embodiment, the second position 154 of the valve 100 is reachable by pushing the activating element 152 through the seat (and, if present, past the protrusions 148). After the activating element 152 has been pushed through the seat the activating element 152 is no longer available for a force transfer to the seat 130 and hence to the valve element 120. Further, the pressure upstream the seat is reduced since the activating element 152 is no longer obstructing a downward flow of fluid through the seat 130. As a consequence, the force on the valve element 120 in downstream direction 107 (first direction 111) is reduced and hence by the bias element the valve element 120 is moved in upstream direction 109 (opposite the first direction 111) with respect to the tubular body 124 (i.e. the valve element 120 is moved (by the bias element) opposite the downstream direction 107 and in a direction from the lower mounting portion to the upper mounting portion of the valve 100, see FIG. 1). The movement in upstream direction 109 (also referred to as upward movement) of the valve element 120 is defined by the look 132 (not shown in FIG. 5) which maintains the valve element 120 in the second position 154 independent of the flow rate of drilling fluid which enters the valve 100 and independent of the presence (or absence) of the activating element 152.

Figure 6:
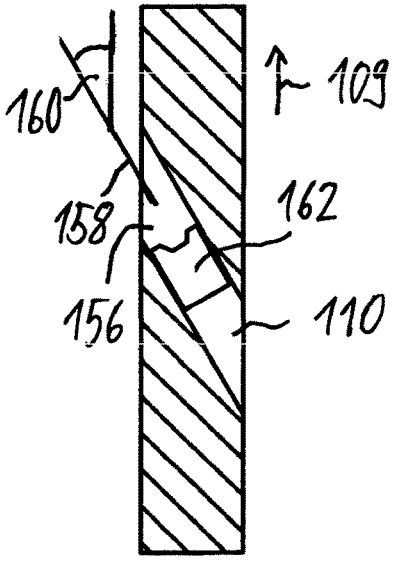
FIG. 6 shows a bypass port of the valve of FIG. 1 to FIG. 5 in greater detail.

FIG. 6 shows a bypass port 110 of the valve 100 of FIG. 1 to FIG. 5 in greater detail. According to an embodiment, the bypass port 110 is configured for directing the second flow portion (i.e. the flow portion of the flow of fluid which exits the (at least one) bypass port) with a velocity component in upstream direction 109 through an outlet 156. According to an embodiment the outlet 156 of the bypass port 110 defines a central axis 158. According to an embodiment, the velocity component in upstream direction 109 is achieved by an outlet 156 which has its central axis 158 positioned under an acute angle 160 with regard to the upstream direction 109. According to an embodiment, the acute angle 160 is in a range between 5 degrees and 85 degrees, e.g. between 10 degrees and 75 degrees, between 20 and 60 degrees or between 30 and 50 degrees. Other intervals or combinations of the above mentioned exemplary intervals are also possible. The smaller the angle, the higher is the velocity component in upstream direction. The velocity component in upstream direction (i.e. the generally upwardly directed second flow portion may assist an upward flow (flow in upstream direction 109) in the annulus surrounding the drillstring even in regions of the annulus which are located downstream the at least one bypass port 110.

According to a further embodiment, the outlet 156 comprises an insert, e.g. a nozzle 162 which provides a (second) flow restriction. According to an embodiment, the flow restriction of the bypass port 110 is determined by the flow restriction provided by the nozzle 162. According to an embodiment, the nozzle 162 is adjustable, i.e. the flow restriction provided by the nozzle 162 is adjustable. According to another embodiment, the flow restriction of the bypass port 110 can be changed by interchanging the nozzle 162 with a nozzle providing the desired flow restriction. Hence, according to an embodiment the nozzle 162 is interchangeable.

In the following the exemplary lock 132 of the valve 100 of FIG. 2 is described in greater detail with regard to FIG. 7 to FIG. 10. As mentioned with regard to FIG. 2, e.g. either the first profile element 136 and the fourth profile element 139 are moveable along the second direction 140 (e.g. are rotatable) or the second profile element 137 and the third profile element are moveable along the second direction 140 (e.g. is rotatable). Accordingly, either the position of the second profile element 137 and the third profile element 138 is fixed along the second direction with regard to the tubular body 124 or the position of the first profile element 136 and the fourth profile element 139 is fixed along the second direction with regard to the tubular body 124 such that the cooperating profile elements (first and second profile element 136, 137/third and fourth profile element 138, 139) are moveable with respect to each other along the second direction.

In a general consideration, the first profile element 136 and the second profile element 137 may be referred to as first pair of profile elements and the third profile element 138 and the fourth profile element 139 may also be referred to as second pair of profile elements. Hence, according to an embodiment the profile elements 136, 137 of the first pair of profile elements are movable with respect to each other along the second direction 140 and the profile elements 138, 139 of the second pair of profile elements are movable with respect to each other along the second direction 140. Further, the first pair of profile elements 136, 137 and the second pair of profile elements 138, 139 are coupled, e.g. mechanically coupled, such that a movement of the profile elements 138, 139 of the second pair of profile elements with respect to each other along the second direction 140 results in a movement of the profile elements 136, 137 of the first pair of profile elements with respect to each other along the second direction 140. Further, according to an embodiment one profile element of the first pair of profile elements and one profile element of the second pair of profile elements is fixed in its position with respect to the tubular body along the first direction and the respective other profile elements of each pair of profile elements are fixed in its position with respect to the valve element along the first direction.

As already mentioned with regard to FIG. 2, the first profile element 136, the second profile element 137, the third profile element 138 and the fourth profile element 139 of the lock 132 are profile elements, i.e. the function and interoperation of these elements 136, 137 and 139 may in an embodiment be defined by respective profiles which are positioned in an opposing manner (e.g. in an embodiment the profile elements 136, 137 of the first pair of profile elements are facing each other and the profile elements 138, 139 of the second pair of profile element are facing each other, as shown in FIG. 2). However it should be understood that a respective function may also be accomplished with other elements, e.g. in general with elements which exert a force to each other at specific relative positions.

According to an embodiment the first profile element 136 and the fourth profile element 139 are fixed in their position relative to the tubular body 124 along the first direction 111 and are fixed with regard to the tubular body 124 along the second direction 140 (which according to an embodiment is perpendicular to the first direction 111).

According to another embodiment the first profile element 136 and the fourth profile element 139 are fixed in their position relative to the tubular body 124 along the first direction 111 and are moveable together with regard to the tubular body 124 along the second direction 140. For example, according to an embodiment the first profile element 136 and the fourth profile element 139 are rotatable together with regard to the tubular body 124. To this end, the first profile element and the second profile element may be mounted on an inner surface of a sleeve that is rotatably mounted in the tubular body 124 (in particular between the tubular body 124 and the valve element 120), e.g. by at least one bearing (not shown).

In FIG. 7 to FIG. 10 the upper part of each figure shows the lock 132 and in particular the relative positions of the profile elements 136, 137, 138, 139 while the lower part of each figure shows the tubular body 124 with the bypass ports 110 and its spatial relationship to the openings 128 of the valve element 120. In accordance with an embodiment the second profile element 137 and the third profile element 138 are shown as a single piece which also referred to as intermediate element 145. While the intermediate element 145 (and hence the second and third profile elements 137, 138) are shown in the same position with regard to the second direction 140 for ease of drawing, this does not necessarily mean that the position of the intermediate element 145 is fixed along the second direction 140 with regard to the tubular body 124 and the valve element 120. While this is the case in one embodiment (as described above), in another embodiment which is described hereinafter the intermediate element 145 is moveable (rotatable) along the second direction with regard to the valve element 120 and the tubular body 124. Hence the orientation (rotational position) of the valve element 120 in the upper part of each of FIG. 7 to FIG. 10 does not correspond to the orientation of the valve element in the lower part of each of FIG. 7 to FIG. 10. This is indicated by the break line between the upper and the lower part. Anyway it is noted that FIG. 7 to FIG. 10 also reflect an embodiment where the first and fourth profile elements 136, 139 are rotatable with regard to the tubular body 124.

The tubular body 124 is shown only in part in FIG. 7 to FIG. 10. It is noted that in FIG. 7 to FIG. 10, in the first direction 111 the tubular body 124 is shown in the same position while the position of the valve element 120 with regard to the tubular body changes from FIG. 7 to FIG. 10.

According to an embodiment, the second profile element 137 and the third profile element 138 are fixed in their position relative to the valve element 120 but are rotatable with regard to the valve element 120 along the second direction 140. According to an embodiment, the opening 155 for inserting rolling bearing elements into the reception space may be provided in the intermediate element 145, e.g. between the second profile element 137 and the third profile element 138. According to an embodiment, after inserting the rolling bearing elements the opening 155 is closed with a closure element, e.g. a screw, e.g. a headless screw. According to an embodiment, a single opening 155 or, in another embodiment two or more openings 155 leading to the same groove may be provided. For ease of drawing, the opening 155 is not shown in FIG. 8 to FIG. 10.

With regard to the tubular body 124 the valve element 120 itself is fixed along the second direction 140 (i.e. the tubular body 124 and the valve element 120 are not moveable (rotatable) with respect to each other) but are moveable along the first direction 111. This may be accomplished by a guide pin 141 that runs in a groove 143 in the valve element 120 (see FIG. 3).

Figure 7:
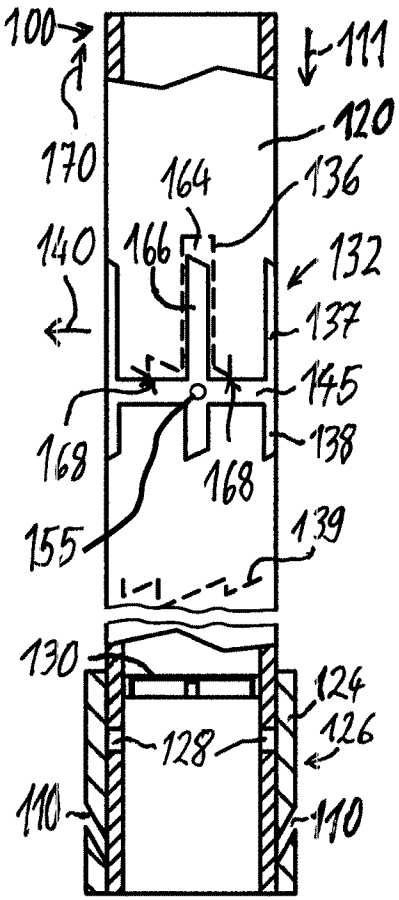
FIG. 7 to FIG. 10 show the valve of FIG. 2 in greater detail and serve to describe an exemplary lock according to embodiments of the herein disclosed subject matter.

FIG. 7 shows the valve element 120 in the first position 126 in which valve element 120 closes the bypass port 110. In this first position 126 opposing portions of the first profile element 136 and the second profile element 137 (e.g. a recess 164 of the first profile element 136 and a finger 166 of the second profile element 137, as shown in FIG. 7) corporate with each other so as to allow the valve element 120 to be in the first position 126. While the recess 164 of the first profile element 136 allows for the first position 126, another portion 168 of the first profile element 136 defines the first position 126 by limiting the movement of the second profile element 137 in a third direction 170, opposite the first direction 111.

Figure 8:
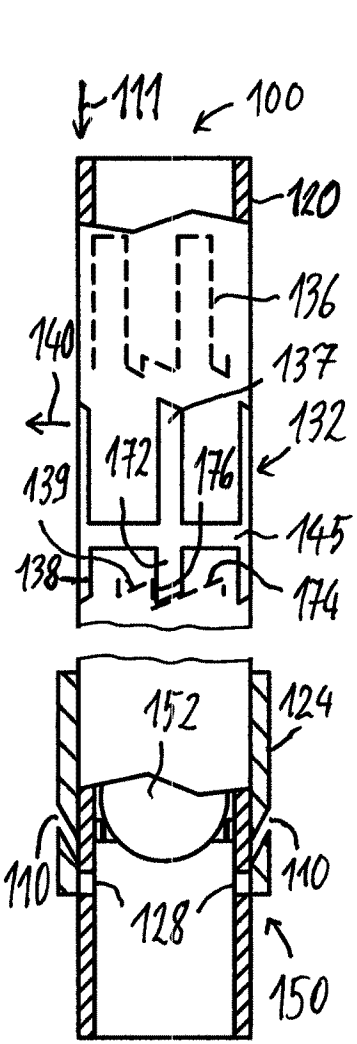

Upon dropping an activating element 152 into the drillstring and pumping behind the activating element 152, the activating element 152 travels to and is received by the seat 130 (see FIG. 8). By increasing the pressure behind (upstream) the activating element 152 (e.g. by continued pumping) the activating element 152 moves the valve element 120 in the first direction 111 (against the action of the bias element).

FIG. 8 shows the valve element 120 in the intermediate position 150. Raising the pressure upstream the activating element 152 to a suitable level (such that the force on the activating element and the seat is sufficient to compress the bias element) results in a movement of the valve element 120 in the first direction 111 until the third profile element 138 engages the fourth profile element 139. According to an embodiment the opposing parts of the third profile element 138 and the fourth profile element 139 (e.g. a finger 172 of the third profile element 138 and an inclined surface 174 of the fourth profile element 139, which inclined surface 174 is inclined with regard to the second direction 140) corporate so as to translate a first force acting on the third profile element 138 in the first direction 111 into a second force acting along the second direction 140. It is noted that the first force is originating from a force exerted by the fluid pressure on the activating element 152 and the seat 130 minus the counterforce of the bias element 134 (see FIG. 2). Thus, the third profile element 138 and the fourth profile element 139 are configured for cooperating so that a force (first force) pushing the third profile element 138 and the fourth profile element 139 against each other along the first direction 111 results in a force acting to move the first profile element 136 and the second profile element 137 with respect to each other along the second direction 140. Accordingly, the intermediate element 145 moves with regard to the fourth profile element 139 and the first profile element 136 along the second direction 140 (compare first and fourth profile element 136, 139 in FIG. 7 and FIG. 8). This movement along the second direction 140 is limited by a lateral stop face 176 of the fourth profile element 139. By further increasing the pressure upstream the activating element 152, the activating element 152 is pushed through the seat 130. In response, due to the reduced force in the first direction 111 the valve element 120 together with the intermediate element 145 is moved upward (in the third direction 170) until the second profile element 137 (and in particular the finger 166 thereof) engages a lock portion 178 of the first profile element 136 (see FIG. 9).

Figure 9:
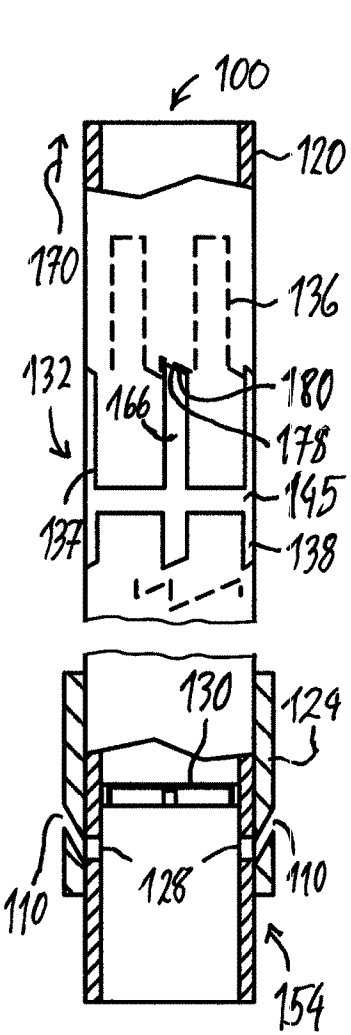

FIG. 9 shows the valve element 120 in the second position in which the second profile element 137 engages the lock portion 178 of the first profile element 136, thus locking the valve 100 in the second position 154, in which the openings 128 are aligned with the bypass ports 110. According to an embodiment, the first profile element 136 comprises a catching surface 180 which guides the second profile element 137 (e.g. the finger 166) to the lock portion 178.

Since in the second position the activating element 152 is not present in the seat 130, a high rate of downward flow of drilling fluid to the drill bit can be achieved with the bypass ports 110 being open (being aligned with the openings 128). Hence, the splitflow valve according to embodiments of the herein disclosed subject matter allow for drilling with the bypass ports 110 being open. Hence, according to an embodiment drilling and circulation operation can be achieved at the same time.

According to an embodiment, at least one portion of at least one of the profile elements 136, 137, 138, 139 (e.g. the finger 166) may be collapsible if subjected to a predetermined force. For example, this may allow an emergency closure of the bypass ports even if the profile elements 136, 137, 138, 139 are in the position in which the bypass ports are locked open.

Figure 10:
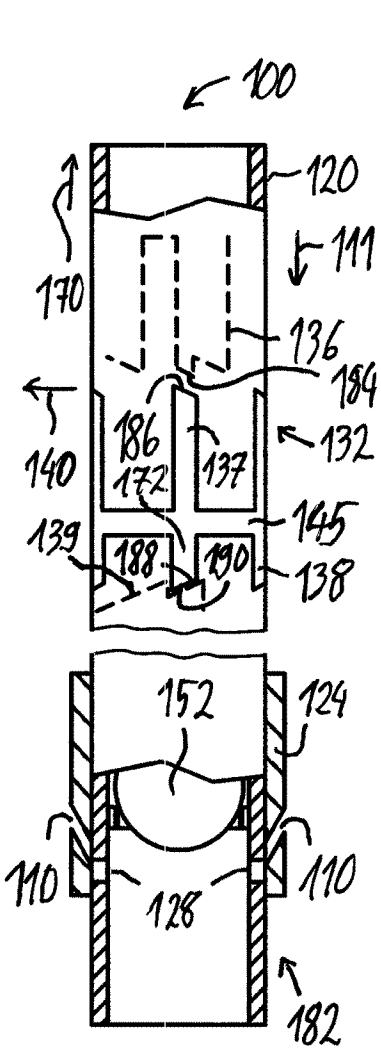

By dropping a further activating element 152 the valve element 120 is moved in the first direction (the second profile element 137 is moved out of engagement with the first profile element 136) to a further intermediate position 182 in which the third profile element 138 (again) comes to rest on the fourth profile element 139 (see FIG. 10).

FIG. 10 shows the valve element 120 in the further intermediate position 182 in which the third profile element 138 comes to rest on the fourth profile element 139. In particular, according to an embodiment opposing parts of the third profile element 138 and the fourth profile element 139 (e.g. the finger 172 of the third profile element 138 and an inclined surface 188 of the fourth profile element 139, which inclined surface 188 is inclined with regard to the second direction 140) corporate so as to translate a first force acting on the third profile element 138 in the first direction 111 into a second force acting along the second direction 140 to thereby rotate the intermediate element and the first and fourth profile elements 136, 139 with respect to each other (in particular, in the embodiment described, rotate the intermediate element 145 with regard to the valve element 120). According to an embodiment the rotation of the intermediate element 145 continues until the third profile element 139 (e.g. the finger 172) comes to rest in a stop position 190 in which further movement in the second direction 140 is prevented by an interaction of the third profile element 138 and the fourth profile element 139.

By removing the activating element 152 from the seat 130 (thereby clearing again the seat 130, e.g. with suitable pressure upstream the activating element 152) the valve element 120 moves in the third direction 170 (opposite to the first direction 111) into the first position 126 (shown in FIG. 7). According to an embodiment, movement of the valve element 120 into the first position 126 requires a further movement of the first profile element 136 along the second direction 140. According to an embodiment, this movement is achieved by suitable opposing force translating surfaces 184, 186 of the first profile element 136 and the second profile element 137, e.g. as shown in FIG. 10.

Generally and in accordance with an embodiment, opposing force translating surfaces of a pair of profile elements (e.g. the surfaces 184, 186 of the first pair of profile elements 136, 137) are provided to move the profile elements of each pair of profile elements (i.e. of the first pair of profile elements and second pair of profile elements) into a defined relative position which allows effecting a further action (e.g. change of position of the valve element 120 with respect to the tubular body 124 along the first direction 111 (i.e. in the first direction 111 or in the opposite direction 170) or further move the profile elements of each pair of profile elements along (or in) the second direction 140. The defined relative positions may be realized with stop faces of the profile elements which extend crosswise or perpendicular to the second direction 140.

According to an embodiment all profile elements have a particular periodicity (e.g. the profiles thereof are repeated along the circumference after a predetermined angle, e.g. every 90 degrees. While e.g. in the example described with regard to the drawings a single finger 166 and a single finger 172 may be sufficient, providing four such fingers 166, 172 (with a periodicity of 90 degrees) reduces the load on each finger and reduces or avoids transverse forces on the valve element 120. According to respective embodiments, the periodicity is 180 degrees, 120 degrees, 90 degrees, 60 degrees or even less.

According to an embodiment, major parts of the tool, e.g. the tubular body 124 and the valve element 120 are made from steel suitable for use in a downhole environment. High wash areas (e.g. the valve element and the nozzles where fluid is required to change direction) are protected by a protective material, e.g. a tungsten carbide material.

Figure 11:
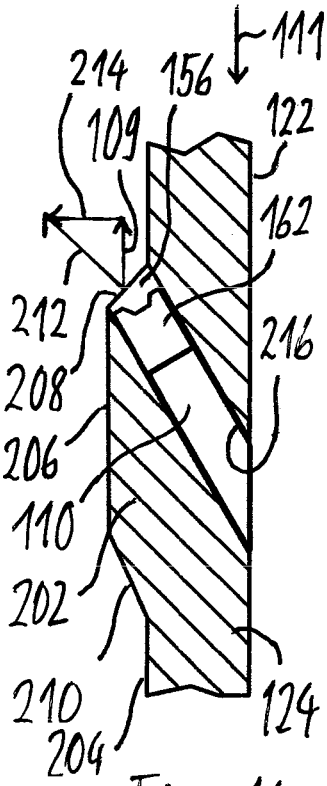
FIG. 11 shows in a cross-sectional view a further tubular body according to embodiments of the herein disclosed subject matter.

FIG. 11 shows in a cross-sectional view a further tubular body 124 according to embodiments of the herein disclosed subject matter. In accordance with an embodiment, the tubular body 124 comprises a protrusion 202 protruding over a neighboring outer surface 204 of the tubular body 124. According to an embodiment, the protrusion 202 comprises a first surface portion 206 (e.g. a pad area). According to an embodiment, the first surface portion 206 is a curved surface portion. For example, according to an embodiment the first surface portion 206 is curved in the circumferential direction. In particular, according to an embodiment, the first surface portion 206 has the shape of a cylinder segment. According to an embodiment, a cylinder axis defined by the cylinder segment extends parallel to the first direction 111.

According to an embodiment, the protrusion 202 comprises a second surface portion 208 extending between the first surface portion 206 and the neighboring surface 204 crosswise the first direction 111. According to an embodiment, the second surface portion 208 is pointing generally upwardly, i.e. a surface normal 212 of the second surface portion 208 has a component in the upstream direction 109, as shown in FIG. 11 and a component in radially outward direction 214.

According to an embodiment, the bypass port extends at least partially through the protrusion 202. In accordance with an embodiment, the protrusion is located in the vicinity of the outlet 156 of the bypass port 110. According to a further embodiment, the outlet 156 is formed in the protrusion 202. For example, according to an embodiment, the outlet 156 is formed in the second surface portion 208, as shown in FIG. 11. The protrusion 202 provides for sufficient space to locate an exchangeable insert (e.g. nozzle 162) in the outlet 156. Further, the protrusion 202 provides for an increased cross-section in particular in the vicinity of the bypass port 110 such that the tubular body 124 can handle the loads imposed upon the split flow valve in service, in particular if the bypass port 110 is configured to provide for a upwardly directed second flow portion 116 (not shown in FIG. 11).

According to an embodiment, the protrusion 202 comprises a third surface portion 210 which is located opposite the first surface portion 208 and is hence pointing downwardly.

According to an embodiment, the surface of the protrusion, in particular the first surface portion 206, the second surface portion with 208 and the third surface portion 210 are provided with heart facing (wear resistant) material, such as tungsten carbide. According to an embodiment, the bypass port 110 is provided with a wear resistant material or is provided with a liner 216 made from wear resistant material. According to an embodiment, the liner 216 extends from the through hole 122 defined by the tubular body 124, e.g. between the through hole 122 and the nozzle 162 (if present).

Figure 12:
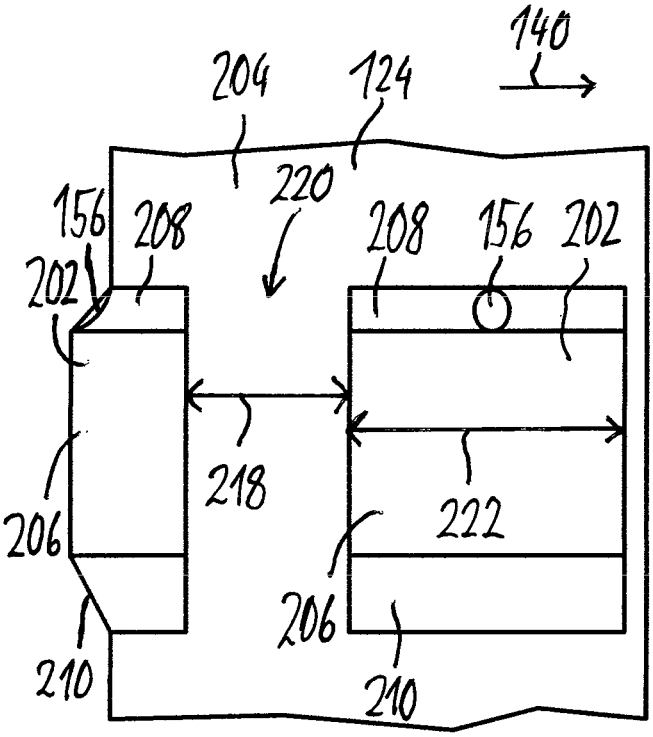
FIG. 12 shows an elevated view of the tubular body of FIG. 11.

FIG. 12 shows an elevated view of the tubular body 124 of FIG. 11.

In accordance with an embodiment, the tubular body 124 comprises two or more protrusions 202. According to a further embodiment, the two or more protrusions 202 are spaced in circumferential direction by a distance 218. Hence, a passage 220 (which may also be referred to as outer passage) is formed between the protrusions 202 thus allowing drilling fluid to flow past the protrusions 202. According to an embodiment, the width 222 of the protrusions in circumferential direction (or second direction 140) is at least two times the mean diameter of the outlet 156, e.g. at least four times the mean diameter of the outlet 156. According to a further embodiment, the width 222 is smaller than 20 times the mean diameter of the outlet 156, e.g. smaller than 10 times or smaller than 5 times the mean diameter of the outlet 156.

Figure 13:
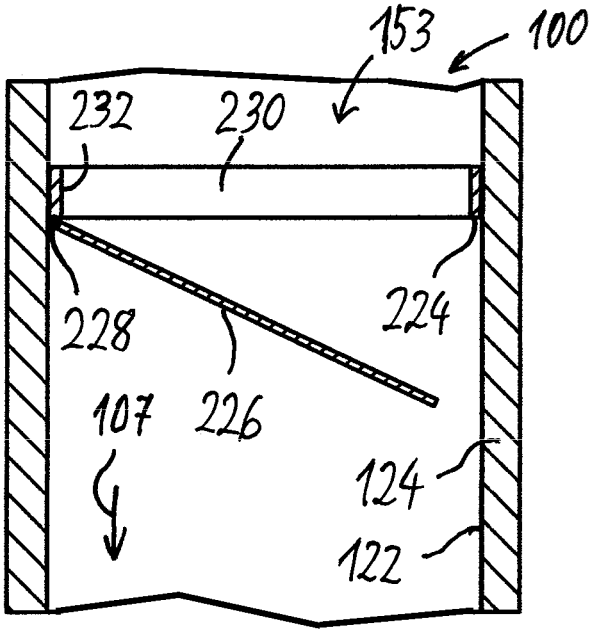
FIG. 13 shows a part of the split flow valve of FIG. 2 in greater detail.

FIG. 13 shows a part of the split flow valve 100 of FIG. 2 in greater detail.

In accordance with an embodiment, the check valve 153 is a flapper valve, e.g. as shown in FIG. 13. In particular, according to an embodiment the check valve 153 comprises a stop face 224 and a pivotable element 226 which is pivotable about an axis 228 in the downward direction 107 and which is capable of seating on the stop face 224. According to further embodiment, the stop face 224 defines an opening 230 which is configured to allow passing of the activating element (not shown in FIG. 13). For example, according to an embodiment, the stop face 224 is a ring shaped stop face, e.g. a circular stop face defining a circular opening 230. According to a further embodiment, the stop face 224 is provided by an insert 232 in the through hole 122. According to an embodiment, the insert 232 is attached to the tubular body 124.

Figure 14:
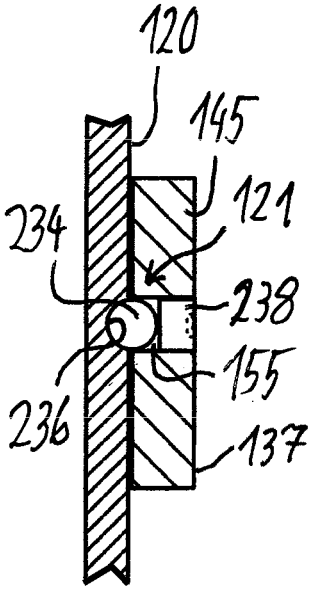
FIG. 14 shows a cross sectional view of part of the valve element and part of the intermediate element mounted on the valve element with a bearing according to embodiments of the herein disclosed subject matter.

FIG. 14 shows a cross sectional view of part of the valve element 120 and a part of the second profile element 137 (which may be formed by the intermediate element 145, as shown in FIG. 14) mounted on the valve element 120 with a bearing 121 according to embodiments of the herein disclosed subject matter.

According to an embodiment, the second profile element 137 (e.g. the intermediate element 145) is rotatably mounted on the valve element 120 by at least one bearing 121. In accordance with an embodiment, the bearing 121 comprises a plurality of rolling bearing elements 234, e.g. balls, one of which is shown in FIG. 14. In accordance with a further embodiment, the rolling bearing elements 234 are insertable into a reception space 236 between the second profile element 137 and the valve element 120 (e.g. between the intermediate element 145 and the valve element 120) through an opening 155. After inserting the rolling bearing elements 234 into the reception space 236, the opening 155 is closed, e.g. by headless screw 238.

It should be noted that any entity disclosed herein (e.g. component, element or device) is not limited to a dedicated entity as described in some embodiments. Rather, the herein disclosed subject matter may be implemented in various ways and with various granularity while still providing the specified functionality. For example, it should be noted that according to embodiments a separate entity (e.g. component, element or device) may be provided for each of the functions disclosed herein. According to other embodiments, an entity (component, element or device) is configured for providing two or more functions as disclosed herein. According to still other embodiments, two or more entities are configured for providing together a function as disclosed herein.

Further, although some embodiments refer to specific entities, e.g. an intermediate element 145 or a drillstring, respectively, it should be understood that each of these references is considered to implicitly disclose in addition a respective reference to the corresponding general term (e.g. second and third profile elements or a hollow string, respectively). Also other terms which relate to specific techniques are considered to implicitly disclose the respective general term with the specified functionality.

Further, while in some embodiments a movement along the second direction (i.e. in the second direction or in the opposite direction) is described it should be understood that this includes (and implicitly discloses) a respective embodiment with a movement in the second direction (or, in another embodiment, a movement in the opposite direction). Further, it should be understood that by suitable configuration of the profile elements (e.g. of the force translating surfaces) even a reciprocating movement (first in the second direction and, later, in the opposite direction (opposite to the second direction)) is also possible.

Further, it should be noted that while the exemplary splitflow valves and methods described with regard to the drawings comprise a particular combination of several embodiments of the herein disclosed subject matter, any other combination of embodiment is also possible and is considered to be disclosed with this application and hence the scope of the herein disclosed subject matter extends to all alternative combinations of two or more of the individual features mentioned or evident from the text. All of these different combinations constitute various alternative examples of the invention.

It should be noted that the term "comprising" does not exclude other elements or steps and the "a" or "an" does not exclude a plurality. Also elements described in association with different embodiments may be combined. It should also be noted that reference signs in the claims shall not be construed as limiting the scope of the claims.

In order to recapitulate some of the above described embodiments of the present invention one can state:

A splitflow valve 100 comprises a tubular body 124, a valve element 120 and a lock 132. The tubular body 124 defines a through hole 122 and has at least one lateral bypass port 110. The valve element 120 defines a flow restriction and is moveable along the through hole 122 along a first direction 111 between a first position 126 and a second position 154, wherein the bypass port 110 is closed by the valve element 120 in the first position 126. In the second position 154 the bypass port 110 is open. The lock 132 maintains the valve element 120 in the second position 154 wherein a flow of fluid entering the through hole 122 of the tubular body 124 is split into a first flow portion passing the flow restriction and a second flow portion exiting the at least one bypass port 110. Further, the lock 132 is deactivatable to allow the valve element 120 to return to the first position 126.

The invention claimed is:

1. A splitflow valve comprising:

a tubular body defining a through hole, the tubular body having at least one lateral bypass port;

a valve element moveable in the through hole along a first direction between a first position and a second position, the bypass port being closed by the valve element in the first position, the bypass port being open in the second position, the valve element defining a flow restriction;

a lock maintaining the valve element in the second position wherein a flow of fluid entering the through hole of the tubular body is split into a first flow portion passing the flow restriction and a second flow portion exiting the at least one bypass port;

the lock being deactivatable to allow the valve element to return to the first position;

the lock further comprising a first profile element and a second profile element moveable with respect to each other along a second direction, transverse to the first direction;

the first profile element or the second profile element being coupled with the valve element such that in the first direction the profile element coupled with the valve element moves in conjunction with the valve element;

wherein the first profile element and the second profile element depending on their position relative to each other along the second direction define the position of the valve element in the first direction; and wherein the second profile element is rotatably mounted on the valve element and wherein the second profile element is rotatable with respect to the valve element along the second direction.

2. The splitflow valve according to claim 1, wherein the bypass port comprises an insert, in particular a nozzle, in particular a nozzle which is interchangeable or a nozzle which is adjustable to adjust the split of the flow of fluid.

3. The splitflow valve according to claim 1, the through hole of the tubular body having an inlet end for receiving the flow of fluid; and wherein the bypass port is tilted toward the inlet end.

4. The splitflow valve according to claim 1, further comprising a third profile element and a fourth profile element;

wherein the third profile element and the fourth profile element are configured for cooperating so that a force pushing the third profile element and the fourth profile element against each other along the first direction results in a force acting to move the third profile element and the fourth profile element with respect to each other along the second direction; and wherein one of the first profile element and the second profile element is coupled with one of the third and the fourth profile element such that a movement of the third and the fourth profile element relative to each other along the second direction results in a movement of the first and second profile element relative to each other along the second direction.

5. The splitflow valve according to claim 4, wherein the second profile element and the third profile element are formed by a single piece of material.

6. The splitflow valve according to claim 1, wherein the second profile element is rotatably mounted on the valve element by a bearing;

in particular wherein the bearing comprises a plurality of rolling bearing elements and wherein the second profile element comprises an opening in the second profile element, the opening providing access to a reception space configured for receiving the rolling bearing elements.

7. The splitflow valve according to claim 1, wherein the valve element is formed by a single piece of material; and/or wherein the splitflow valve further comprises a check valve, in particular wherein the check valve is a flapper valve.

8. The splitflow valve according to claim 1, wherein the tubular body comprises a protrusion protruding over a neighboring outer surface of the tubular body, wherein in particular the bypass port extends at least partially through the protrusion.

9. The splitflow valve according to claim 8, wherein the protrusion comprises a first surface portion having the shape of a cylinder segment.

10. The splitflow valve according to claim 1, the valve element comprising a seat for receiving an activating element, the activating element allowing to move the valve element into the second position;

the activating element being removable from the seat; and the lock being configured for maintaining the valve element in the second position after removal of the activating element from the seat to allow the first flow portion pass through the seat.

11. A splitflow valve assembly comprising a splitflow valve according to claim 10; and the activating element.

12. The splitflow valve according to claim 1, further comprising a bias element biasing the valve element into the first position;

the activating element received in the seat allowing to increase a fluid pressure upstream the seat to thereby move the valve element against a force of the bias element.

13. A method for operating a splitflow valve comprising a tubular body defining a through hole, the tubular body having at least one lateral bypass port and a valve element moveable in the through hole along a first direction between a first position and a second position, the bypass port being closed by the valve element in the first position, the bypass port being open in the second position, the valve element defining a flow restriction, the splitflow valve further comprising a first profile element and a second profile element moveable with respect to each other along a second direction, transverse to the first direction, wherein the second profile element is rotatable with respect to the valve element, the method comprising:

moving the valve element from the first position into the second position;

maintaining the valve element in the second position while having the flow restriction unobstructed such that a flow of fluid entering the through hole of the tubular body is split into a first flow portion passing the flow restriction and a second flow portion exiting the at least one bypass port;

thereafter moving the valve element from the second position into the first position;

by rotating the second profile element with regard to the valve element, moving the first profile element and the second profile element with respect to each other along the second direction into a locking position in which the first profile element and the second profile element cooperate with each other to maintain the valve element along the second position.

14. The method according to claim 13, further comprising:

adjusting the split of the flow of fluid, in particular by interchanging or adjusting an insert, in particular a nozzle, of the bypass port.

15. The method according to claim 13, directing the second flow portion such that the second flow portion exits the bypass port with a velocity component in upstream direction, opposite a downstream direction in which the flow of fluid enters the through hole.

16. The method according to claim 13, wherein the valve element comprises a seat, the method further comprising:

receiving an activating element in the seat;

increasing a fluid pressure upstream the activating element to thereby move the valve element to the second position;

removing the activating element from the seat; and maintaining the valve element in the second position and passing the first flow portion through the seat.

17. The method according to claim 16, further comprising:

biasing the valve element with a biasing force into the first position;

increasing a fluid pressure upstream the seat to thereby move the valve element against the biasing force into the second position.

18. The method according to claim 13, wherein the splitflow valve further comprises a third profile element and a fourth profile element, the method further comprising:

pushing the third profile element and the fourth profile element against each other along the first direction to thereby generate, by virtue of respectively configured opposing surface profiles of the third profile element and the fourth profile element, a force acting to move the first and the second profile element with respect to each other along the second direction.

19. A splitflow valve comprising:

a tubular body defining a through hole, the tubular body having at least one lateral bypass port;

a valve element moveable in the through hole along a first direction between a first position and a second position, the bypass port being closed by the valve element in the first position, the bypass port being open in the second position, the valve element defining a flow restriction;

a lock maintaining the valve element in the second position wherein a flow of fluid entering the through hole of the tubular body is split into a first flow portion passing the flow restriction and a second flow portion exiting the at least one bypass port;

the lock being deactivatable to allow the valve element to return to the first position;

the tubular body comprising a protrusion protruding over a neighboring outer surface of the tubular body, wherein the bypass port extends at least partially through the protrusion, and wherein the bypass port is configured to provide for an upwardly directed second flow portion;

the lock further comprising a first profile element and a second profile element moveable with respect to each other along a second direction, transverse to the first direction;

the first profile element or the second profile element being coupled with the valve element such that in the first direction the profile element coupled with the valve element moves in conjunction with the valve element;

wherein the first profile element and the second profile element depending on their position relative to each other along the second direction define the position of the valve element in the first direction; and wherein the second profile element is rotatably mounted on the valve element and wherein the second profile element is rotatable with respect to the valve element along the second direction.

* * * * *